United States Patent [19]

LeVere, Jr.

[11] Patent Number: 4,882,802

[45] Date of Patent: Nov. 28, 1989

[54] VERSATILE CONSTRUCTION BROOM HOLDER

[76] Inventor: Chester C. LeVere, Jr., 6391 W. 60th, #212, Arvada, Colo. 80003

[21] Appl. No.: 207,264

[22] Filed: Jun. 15, 1988

[51] Int. Cl.[4] ..... A46B 7/04; A46B 5/02; B25G 3/02

[52] U.S. Cl. ..... 15/144 R; 15/146; 15/160; 15/172; 15/176.6

[58] Field of Search ..... 15/111, 114, 143 R, 15/144 R, 145, 146, 115, 116.1, 116.2, 160, 159 R, 159 A, 171, 172, 173, 177, 194, 202, 178, 175, 201, 176.1, 176.2, 176.3, 176.4, 176.5, 176.6; D4/130, 132, 134, 135, 136, 131, 138

[56] References Cited

U.S. PATENT DOCUMENTS

| | | | |
|---|---|---|---|
| 1,256,565 | 2/1918 | Inghram | 15/144 R X |
| 1,311,657 | 7/1919 | Levins | 15/146 |
| 1,329,694 | 2/1920 | Beck | 15/160 |
| 1,340,931 | 5/1920 | Cazel et al. | 15/144 R X |
| 1,349,680 | 8/1920 | Link | 15/202 X |
| 1,490,078 | 4/1924 | Neff | 15/194 |
| 2,044,595 | 6/1936 | Schumann | 15/194 X |
| 2,112,349 | 3/1938 | Schumacher | 15/172 X |
| 2,264,736 | 12/1941 | Baker | 15/176.1 X |
| 2,796,621 | 6/1957 | Legge | 15/202 |
| 2,799,037 | 7/1957 | Grogan | 15/172 |
| 2,855,618 | 10/1958 | Jones | 15/160 X |
| 3,906,580 | 9/1975 | Smith et al. | 15/115 |

FOREIGN PATENT DOCUMENTS

| | | | |
|---|---|---|---|
| 618142 | 8/1935 | Fed. Rep. of Germany | 15/146 |

*Primary Examiner*—Harvey C. Hornsby
*Assistant Examiner*—Scott J. Haugland
*Attorney, Agent, or Firm*—Dorr, Carson, Sloan & Peterson

[57] ABSTRACT

An improved broom holder to finish newly laid concrete surfaces is provided having a collar designed to accept a number of different commerically available broom handle adaptor attachments. A broom head is adjustably mounted to the collar so that the broom handle can be positioned along the length of the broom head in order to brush hard to reach areas. Interchangeable broom fiber strips are easily mounted to the broom head. A broom fiber strip appropriate to the job at hand can be chosen and slipped into the broom head where it is clamped in place. The broom fiber strips are available in a variety of configurations and color-coded fiber types.

24 Claims, 4 Drawing Sheets

30
48
50
56
58
34
44
40
42
38
46
36
32

60
62
66
94
98
92
96
76
70
82
74
68
72
80
84
64

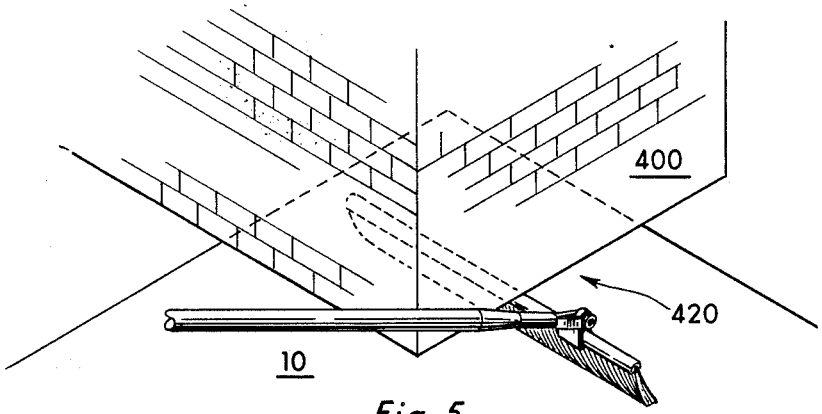
Fig. 5
Fig. 8
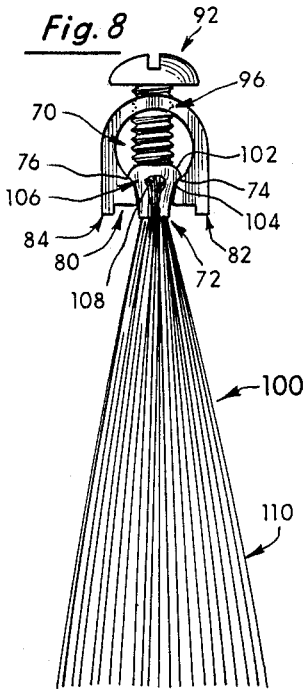
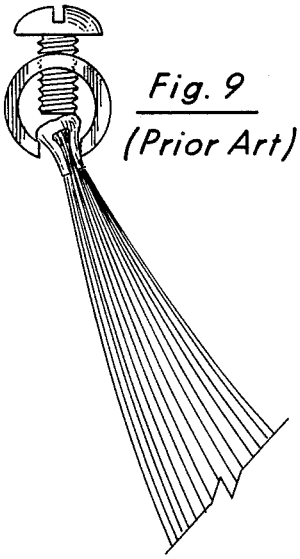
Fig. 9
(Prior Art)
Fig. 11
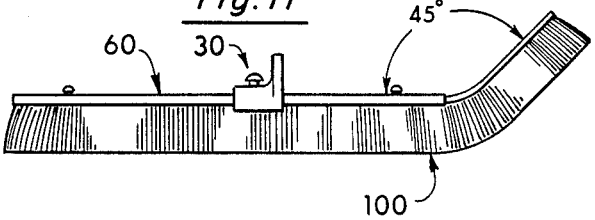
Fig. 10
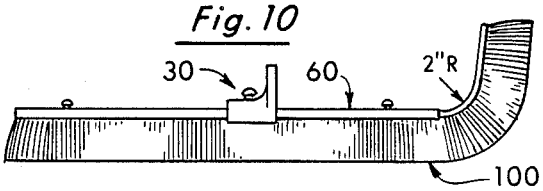

VERSATILE CONSTRUCTION BROOM HOLDER

BACKGROUND OF THE INVENTION

1. Field of the Invention

This invention pertains to an improved versatile concrete finishing broom developed for the purpose of creating a textured non-slip surface on newly laid concrete.

2. Related Application

Applicant has a related co-pending design application 07/025,797 to a construction broom holder.

3. Statement of Problem

In installing concrete surfaces, such as sidewalks, steps, roads, bridges, etc., it is often desired to create a non-slip texture on the surface. This is done by brushing the newly laid concrete with a broom having specially designed bristles. Depending on the type of bristles in the broom head and the shape of the broom head, different textures may be created. In order to complete a particular job, it is often necessary to use a variety of broom heads, having various configurations and bristles. Specially configured broom heads are occasionally needed to finish hard to reach areas and specially shaped surfaces.

Different textures are required for different surfaces, i.e. finer textures on residential walkways, pool sides, tennis courts and patios require softer brushes than do surfaces such as city sidewalks, driveways and walkways. Surfaces such as highways, bridges and inclined drives require even rougher surfaces which require the use of stiffer fibers.

Costly delays are often incurred while waiting for the concrete to set up sufficiently to be brushed by broom heads having stiff fibers. In the other extreme, if the concrete sets faster than expected, then a critical rush is required, needing another broom head with stiffer fibers.

Currently there are a number of commercially available broom handles utilizing a variety of different connection means to different broom heads. The variety of different connection means can often create difficulties at a job site if a particular broom head is desired for use with a handle from a different manufacturer.

In the past, the brushing has been done with wooden block brooms 200, such as that shown in FIG. 1. The wooden block brooms are not durable and would often split or warp, or break at the handle joint 230 requiring frequent replacements of the broom head 210 or the entire broom 200. Also the fibers 240 often shed or pull out during use and become worn necessitating replacement of the entire broom head 210.

Applicant's co-pending design application 07/025,797 shown in FIG. 2 discloses a broom holder 300 comprising an aluminum block 310 with interchangeable broom strips 350. The block 310 uses a welded collar 340 and bracket 320 which can result in an annealed spot prone to bend or break. Also the broom head 350 tends to slip within the bracket 320 during use.

There is a need for an improved broom holder design that will provide greater versatility by eliminating the number of different brooms needed at a job site. There is also need for an improved broom holder that will better stand up to the stresses involved in brushing the surface of newly laid concrete.

SOLUTION TO PROBLEM

The present invention solves these problems by creating a broom bracket collar that will accept a number of different commercially available handle adaptor attachments thus obviating the need for a large number of different brooms on a job site.

This invention also provides a broom bracket collar that a trowel handle can be adapted to fit on to for use in close work that requires special attention to detail.

The present invention further provide adjustability of the collar relative to the broom head bracket in order for the broom handle to change position along the length of the broom head. This feature allows the user to easily sweep under overhangs, in corners and other areas previously difficult to reach without using different specially designed brooms.

To further reduce the number of brooms needed on a job site, the present invention provides a bracket design utilizing interchangeable broom fiber strips. This design allows quick and easy interchanging of broom strips depending on the particular need of the current job. The present invention is capable of using a variety of broom fiber strips of different shapes and fibers. The strips are less expensive, easier to replace and more convenient to keep on hand than having to maintain an equal number of entire broom heads.

The design of the present invention provides a collar capable of standing up to the stresses of brushing fresh concrete. This design gives added strength over the prior art devices which utilized either wooden block brooms or welded collars.

To better stand up to the stresses of brushing the concrete, the present invention provides a broom head bracket that will accept interchangeable broom fiber strips in such a manner so as to prevent twisting and slipping of the broom fiber strips during use. These and other features of the present invention will become apparent from the following written description of the invention taken in conjunction with the drawings of the invention.

SUMMARY OF THE INVENTION

The present invention accomplishes these solutions by an improved broom holder design. The broom holder of the current invention comprises a collar, a broom head bracket and interchangeable broom fiber strips. A broom fiber strip appropriate to the job at hand is chosen and slipped into the broom head bracket where it is clamped in place. The bracket is then adjusted relative to the collar to a desired position, then locked in place. A preferred commercially available broom handle is mounted to the collar and the broom is then set up to brush the freshly laid concrete surface.

The collar comprises an integral one-piece aluminum collar body which obviates the need for welding of the collar. The welding of prior art collars causes annealing of the structure, thus creating a soft spot on the collar causing the collar to bend or break under stress. The present design allows a uniform temper throughout the collar creating a rigid structure enabling the collar to withstand the rigors of brushing fresh concrete.

The collar comprises an upstanding arm perpendicular to the length of the collar body at one end of the collar body. This arm is designed to accept all commercially available handle adaptor attachments including a clevis type adaptor for snap-clip handles; single action Fresno adaptors for screw together handles, single action adaptors for standard broom handle male threads and Fresno handles with clevis type attachments.

The collar can also be used with easy grip straight or camel-back trowel handles. This allows the broom head to be used for close work that requires special attention to detail and contours.

The collar body further comprises an inverted U-shaped channel along the length of the body having a slot in the bottom face of the collar body narrower than the channel opening into the channel along the length of the channel. The edges of the slot form retaining edges to prevent the broom head from dropping out of the collar. The collar further comprises clamping means, such as a screw, to clamp the collar on the head.

The broom head of the current invention comprises a one-piece aluminum inverted U-shaped body extending the length of most standard broom strips. The body comprises an internal circular slot along the length of the body to retain the broom strips. A first channel opens into the slot along the length of the slot. The edges of the slot leading into the channel are tapered as well as the edges of the channel adjacent the slot. The first channel opens into a rectangular open channel on the longitudinal bottom face of the head. The head further comprises clamping means to retain the broom strips to the head.

The inverted U-shaped provides additional reinforcement at the bottom corners of the head where the highest stresses occur during the sweeping operation. The upstanding edges on the open rectangular channel engage the retaining edges of the slot on the collar. This provides positive clamping of the collar and head while allowing the head and strip to be adjustable relative to the collar.

The interchangeable broom strips comprise an internal channel. The external sides of the body are angled to mate with the tapered edges of the head slot and first channel of the bracket body providing a continuous mating surface along the length of the broom strip. This feature facilitates installation of the broom strip in the head. The broom strip is inserted into one end of the channels and slot of the head until the edges of the strip and head are aligned. Clamping means such as screws mounted along the top edge of the head are tightened, causing the mating surfaces of the broom strip and the head to engage. This eliminates any misalignment of the broom strip so the strip is held in perfect alignment with the broom head. The tapered surfaces also create more contact surface between the head and the strips so there is less chance the strip will slip out of position during use.

The strips come in a number of different configurations for different purposes such as for sweeping curbs and gutters in one stroke. The strips also come in different color-coded bristles so that the strips can quickly be changed for varying conditions. One type of fiber stiffness is necessary for rough textured surfaces while a softer fiber is needed for fine textured surfaces. Also, if the concrete is setting up faster than expected or slower than expected, then an appropriate strip can be inserted allowing the job to proceed as scheduled.

The features of the current invention provide a broom holder having great versatility, eliminating the need to have a large number of brooms on a job site.

DESCRIPTION OF THE DRAWING

FIG. 5 is a view of the current invention adjusted to sweep under overhangs;

FIG. 8 is an end view of the head and a broom strip of the present invention;

FIG. 9 is an end view of the prior art head and broom strip;

FIG. 10 is a view of a broom strip used for sweeping conventional curbs; and

FIG. 11 is a view of a broom strip used for sweeping "hollywood" style curbs.

DETAILED DESCRIPTION OF THE DRAWINGS

Figure 1:
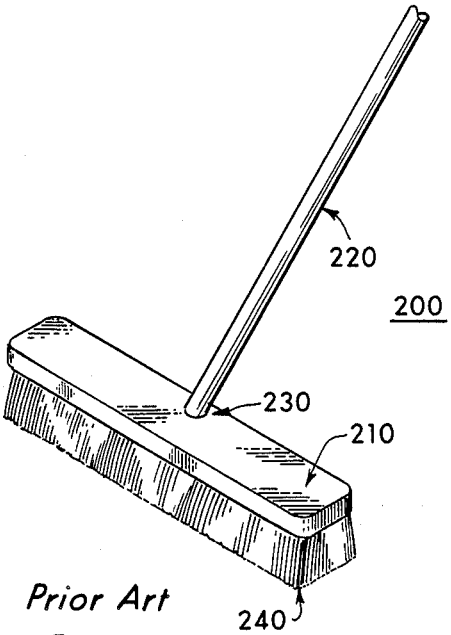
Prior Art Fig. 1
FIG. 1 shows a prior art wooden block broom.
Figure 2:
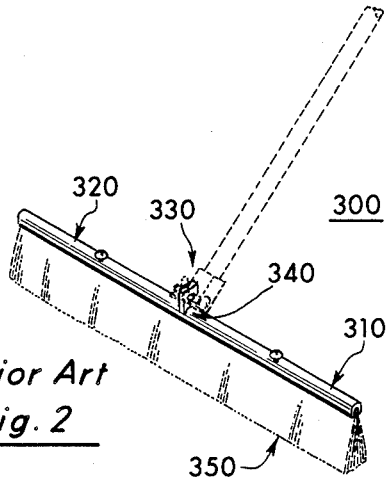
Prior Art Fig. 2
FIG. 2 shows a prior art aluminum bracket broom.

The prior art devices of which the current invention is an improvement over are shown in FIGS. 1 and 2. The wooden block brooms 200 as shown in FIG. 1 do not stand up well under the normal use in concrete surface finishing. The blocks 210 tend to split and warp or the handles 220 snap at the block handle connection 230. The fibers 240 tend to pull out and require frequent replacement of the entire wooden blocks 210 as they become worn or loaded up.

The broom holder in FIG. 2 as disclosed in applicant's co-pending application 07/025,797 utilizes a welded aluminum collar 340 and interchangeable fiber strips 350. The welding of the aluminum collar 340 tends to anneal the collar creating soft spots which cause the collar to bend or break under stress. The strips 350 tend to misalign and slip within the head 320 under heavy use.

Figure 3:
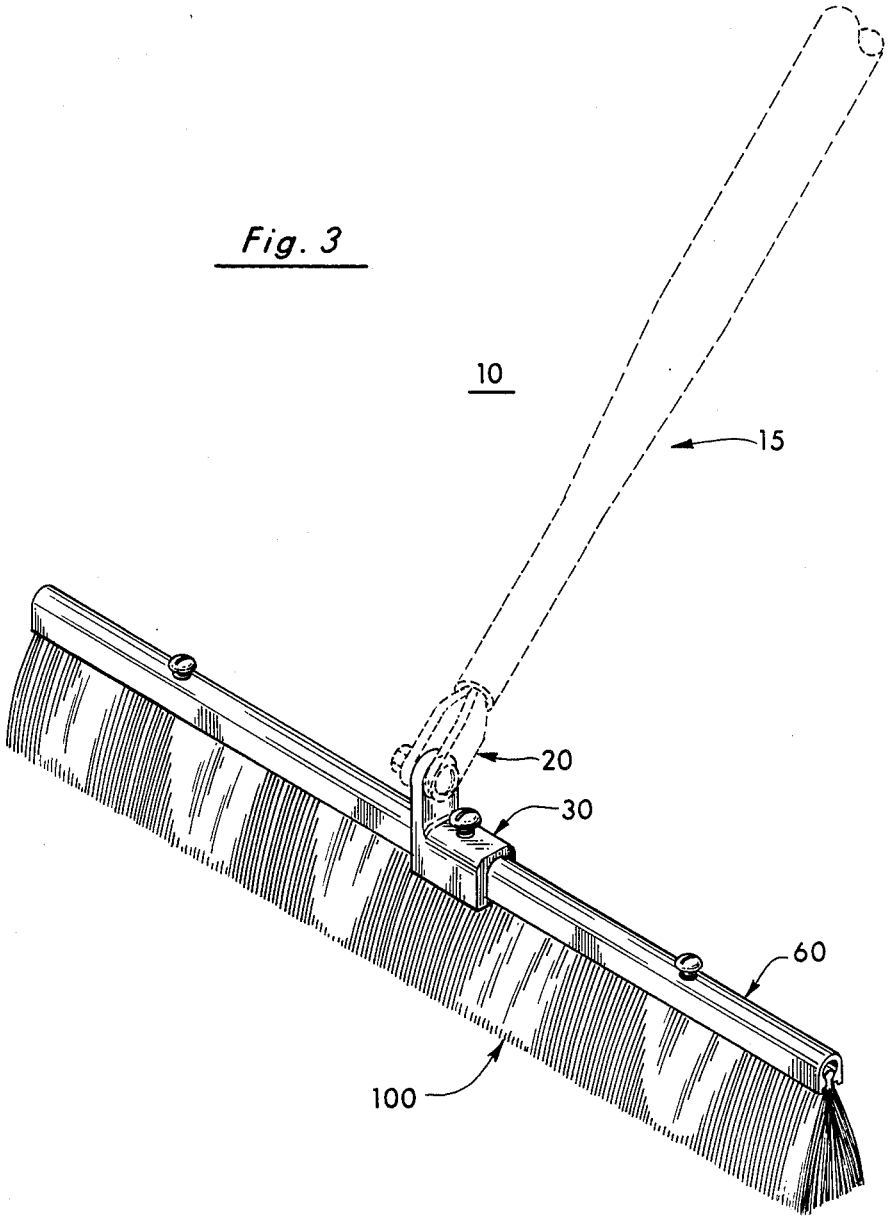
FIG. 3 is a perspective view of the broom of the present invention.

A preferred embodiment of the improved broom holder of the current invention is shown in FIG. 3. This embodiment includes the broom holder 10 as used with a broom handle 15 and handle adaptor 20. The broom holder 10 is designed to be used with a number of different commercially available adaptor attachments, for example: Goldblatt number's 16510 M7 clevis type for snap-clip handles; 16662 M7 single action Fresno adaptor for screw together handles; 16293 H7 single action adaptor for any standard broom handle male thread; and 16286 M7 five foot wood Fresno handle with clevis-type attachment available from Goldblatt Tool Company, P.O. Box 2334, Kansas City, Kansas 66110. The collar is also compatible with Joyce brush side-mount and center mount broom handle single action sockets.

Figure 4:
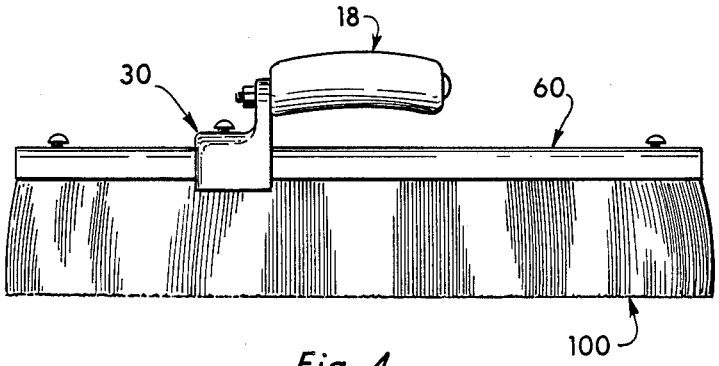
FIG. 4 is a view of the current invention with a trowel handle adapted to the broom head.

The holder is also designed to be used with trowel handles. The use of the holder with trowel handles as shown in FIG. 4 allows the holder to be used for close work that requires special attention to detail and contours particularly when finishing steps and curbs. Easy grip straight or camel back trowel handles 18 will adapt to the bracket collar with only minor modification. Commonly available handles such as the Goldblatt 03408 M7 and 03409 M7; and the Marshalltown 401 and 402 handles available from Marshalltown Trowel Company, P.O. Box 738, Marshalltown, Iowa 50158 will mate with the bracket collar 30 with a recess on the mounting face of the handle 18 that eliminates turning and spinning.

The current invention is not intended to be limited solely to the enumerated commercially available handle adaptors; but is intended to be used for other types as well within the range and scope of the inventive concept.

The improved broom holder of the current invention as shown in FIG. 3 comprises an integral one-piece aluminum collar 30, a broom head 60 and broom strip 100. The head 60 is inserted into one end of the collar 30 and moved relative to the collar to a desired position. Locking means, such as a screw 56, on the collar as discussed below are tightened, clamping the collar 30 and head 60 relative to one another. A strip 100 is inserted into one end of the head 60 until it is properly aligned, then clamped in place by the locking means, such as screws 82 and 96 as discussed below. The collar 30 is then attached to a commercially available adaptor 20 and handle 15 and the broom is then prepared to use in finishing fresh concrete surfaces. Different broom strips and broom handles can be easily interchanged with the broom holder of the current invention as desired.

The broom handle 15 can easily be adjusted to various positions along the broom head 60 in order to facilitate the brushing operation especially in hard to reach areas. FIG. 5 shows an example of a broom 10 adjusted to easily sweep under an overhang 420.

Figures 6, 7:
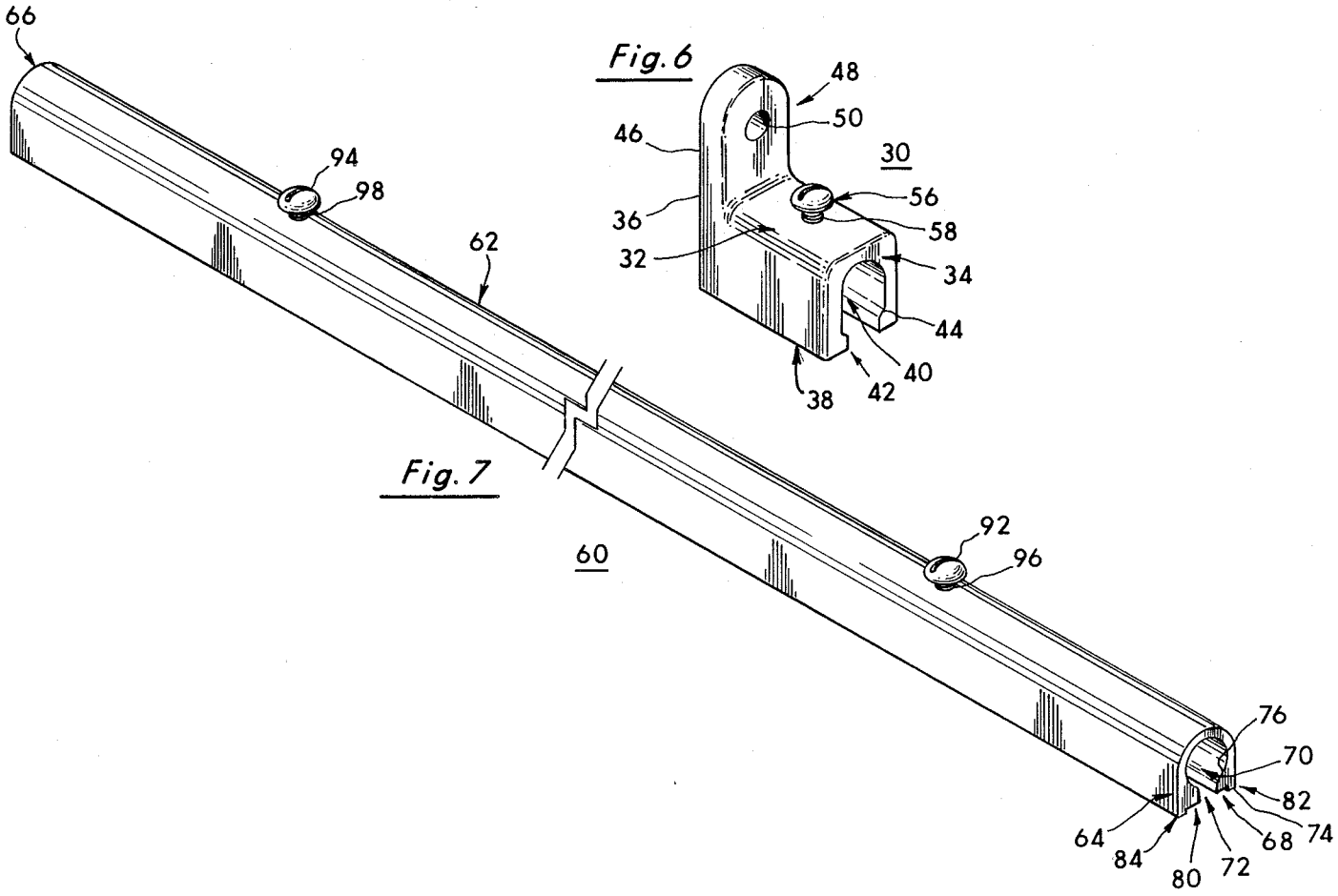
FIG. 6 is a perspective view of the collar of the present invention.
FIG. 7 is a perspective view of the head of the present invention.

The details of the collar 30 are shown in FIG. 6. The collar 30 comprises an integral one-piece aluminum body 32 having opposing ends 34 and 36 and a bottom face 38. The body 32 includes an inverted U-shaped channel 40 extending the length of the body 32. A slot 42 lies on the bottom face 38 of the body 32 opening into the channel 40 and extending the length of the body. The slot 42 is narrower than the width of the channel 38 forming retaining edges 44 on the body 32. An upstanding arm 46 is integrally formed on the top of the body perpendicular to the length of the body and extending in the same vertical plane as the end 36. The top portion 48 of the arm 46 is formed in an oval shaped with aperture 50 contained therein near the top portion 48. The collar further comprises locking means such as screw 56 inserted in a threaded aperture 58 in the top of the collar body.

A commercially available handle adaptor 20 is mounted to the arm 46 of the collar 30 by fastening the adaptor 20 through the aperture 50 and securing the adaptor 20 thereto as shown in FIG 3. The collar of the present invention is not intended to be limited by the above discussion of the preferred embodiment but is intended to extend to other configurations and materials as within the range and scope of the inventive concept.

The broom head 60 of the current invention is shown in detail in FIGS. 7 and 8. The head 60 comprises an aluminum elongated inverted U-shaped body 62 having ends 64 and 66 and bottom surface 68. The body 62 comprises an internal circular channel 70 extending the length of the body 62. Slot 72 extends the length of the body opening into the channel 70. The inner edges 74 of the slot 72 taper into the channel 70. The edges 76 of the channel adjacent the slot 72 taper at the same angle as the slot edges 74 to form continuous surfaces. An open rectangular channel 80 is formed along the bottom surface 68 of the head body 62. The slot 72 forms an opening between the circular channel 70 and the rectangular channel 80. The channel 80 comprises corner edges 82 and 84 on the bottom surface 68 of the head body 62. These corner edges add reinforcement to the bracket body at areas of high stress which occur during the operation of brushing the fresh concrete surface. The edges 82,84 form gripping means for the retaining edges 44 of the collar body to clamp against. The head body 62 further comprises locking means such as screws 92 and 94 inserted in respective threaded apertures 96 and 98 to clamp a broom strip in the head 60.

The broom head 60 is inserted in the channel 40 at one end of the collar body 32. The head 60 and collar 30 are moved relative to one another until a desired position is located. Screw 56 is then tightened against the top of the head body 62, forcing the bracket edges 82,84 against the retaining edges 44 on the collar 30 until the collar is securely clamped to the head. Should another position of the handle 15 relative to the broom head be desired, screw 56 may be loosened, the collar 30 moved relative to the bracket 60 and the screw 56 retightened.

It is to be understood that the broom holder as described is not meant to be limited by this description, but includes other designs and modifications within the range and scope of the inventive concept. For example, different locking means other than screws could be used, rectangular shaped channels and bodies could be used in lieu of the circular channels and U-shaped bodies, etc.

The commercially available broom strip 100 used with the current invention is shown in FIG. 8. The strip comprises an elongated body 102 having sides 104 and 106, forming an internal channel 108. Bristle fibers 110 are inserted within the channel 108 and the sides 104 and 106 are pressed inward to retain the fibers within the channel. The sides 104 and 106 are angled inward with respect to the top of the body 102. The angled sides 104, 106 of the strip are designed to mate with the tapered edges 74 and 76 of the broom head bracket.

The strips 100 are inserted into one end of the slot 72 and channels 70 and 80 of the head body 62. The strip 100 is moved relative to the head 60 within the slot 72 and channels 70 and 80 until the desired alignment is achieved. The screws 92 and 94 are tightened against the top of the strip body. This forces the angled sides 104, 106 into engagement with the tapered edges 74, 76 of the head 60. The strip 100 is thus held in perfect lateral alignment with the broom head.

Prior art broom heads and strips as shown in FIG. 9 tend to hang up during installation or become misaligned either during installation or during use. The use of the tapered edges and sides of the head and strips in the current invention solves these problems. The tapered fit provides more contact surface between the strip 100 and head 60 thus there is less chance for slipping out of position. The improved design provides for a faster, more efficient installation of the strips in the head.

The strips are designed to be available in a number of different configurations and fiber styles, all of which can be interchanged on the broom head. For instance, in FIG. 10, a broom strip 100 is shown designed to brush in a single stroke, a "standard" curb with a 2 inch radius at the intersection of the gutter and barrier rise. Previously with a conventional broom head, this would have taken two or more strokes. FIG. 11 shows a broom strip 100 designed to brush in a single stroke, a "Hollywood" style curb having a forty-five degree angle at the intersection of the gutter and barrier rise. Additional designs can easily be fabricated within the concept of the current invention.

The strips 100 also come in a variety of interchangeable color coded fiber strips of different fiber stiffnesses. For example, a rough textured surface is desired for highways, bridges or inclined drives. For these applications, a yellow 0.016 inch Proex fiber is recommended. This yellow strip would also be useful for those situations when the concrete begins to set up faster than expected. For general applications such as city sidewalks, driveways and walkways, the black fiber strip is recommended. For a finetextured concrete finish, suitable for residential walkways, poolsides, tennis courts and patios, the grey 0.011 shalon polystyrene fiber is used. This soft fiber is also useful for allowing the contractor to finish newly laid concrete with out having to delay until the concrete starts to set. Various other color-coded fibers can be quickly interchanged as required for a particular job condition. The broom strips 100 as described are not meant to be limited by this description, but include other designs and modifications within the range and scope of the inventive concept.

Thus, an improved broom holder is provided that will allow a variety of broom strips and handles to be quickly and easily interchanged according to a current job site condition as well as providing adjustability of the broom head to finish difficult to reach areas.

Although the invention has been described in detail, it is to be clearly understood that the description is by way of illustration and is not to be taken by way of limitation, the spirit and scope of the invention being limited only to the terms of the claims.

While preferred embodiments of the present invention have been shown, it is to be expressly understood that modifications and changes may be made thereto and that the present invention is set forth in the following claims.

I claim:

1. An improved broom holder for finishing newly laid concrete surfaces, comprising a collar, means on said collar capable of mounting handle adaptor attachments of differing sizes and shapes quickly and easily on said collar, said handle adaptor attachment means comprising an upstanding arm on the top of said collar perpendicular to said collar extending in a vertical plane with one end face of said collar, a broom head, means on said collar to adjustably secure said collar at various positions along the length of said broom head to said broom head, and interchangeable broom strips mountable in said head.

2. The broom holder as set forth in claim 1, wherein said collar comprises an internal inverted U-shaped channel extending the length of said collar to receive said head.

3. The broom holder as set forth in claim 2, wherein said collar further comprises a slot on the bottom face of said collar parallel to and opening into said channel and retaining edges formed on the sides of said slot opening into said channel.

4. The broom holder as set forth in claim 1, wherein said broom holder further comprises means to clamp said head to said collar.

5. An improved broom holder for finishing newly laid concrete surfaces, comprising a collar, means on said collar capable of mounting handle adaptor attachments of differing sizes and shapes quickly and easily on said collar, a broom head comprising an elongated inverted U-shaped body, said body comprising an internal circular channel to receive said broom strip, means on said collar to adjustably secure said collar at various positions along the length of said broom head to said broom head, and interchangeable broom strips mountable in said head.

6. The broom holder as set forth in claim 5, wherein said head further comprises a slot parallel to and opening into said circular channel.

7. The broom holder as set forth in claim 6, wherein said head comprises tapered inner edges on said circular channel, tapered inner edges on said slot adjacent said circular channel, said tapered inner edges on said circular channel leading into said tapered inner edges of said slot to form continuous surfaces.

8. The broom holder as set forth in claim 7, wherein said head comprises an open channel on the bottom face of said head parallel to and opening into said slot, said channel forming upstanding corner edges on said bottom face of said head body.

9. The broom holder as set forth in claim 7, wherein said broom strips are of a type comprising an elongated body having angled external sides adapted to mate with said tapered edges of said head, said elongated body comprising an internal channel adapted to retain fiber bristles.

10. The broom holder as set forth in claim 9, wherein said broom strips comprise a plurality of broom strips in a variety of configurations and types of fibers.

11. The broom holder as set forth in claim 5, wherein said head comprises means to clamp said broom strips to said head.

12. The broom holder as set forth in claim 5, wherein said head body extends substantially the length of said broom strips.

13. The broom holder as set forth in claim 1, wherein said broom holder further comprises means on said collar to adjust said handle adaptor attachments to various angular positions.

14. An improved broom holder for finishing newly laid concrete surfaces, comprising a collar, a broom head and interchangeable broom strips; said collar comprising an integral one-piece body, an upstanding arm formed on said body perpendicular to said collar and extending in a vertical plane with one end face of said body, means on said arm capable of mounting handle adaptor attachments of differing sizes and shapes quickly and easily to said collar, and means to adjustably secure said collar at positions along substantially the entire length of said head on said head; said head comprising an elongated inverted U-shaped body having an internal circular channel adapted to receive said broom strip and means to clamp one of said broom strips to said head; said broom strips are of a type comprising an elongated body having angled external sides and an internal channel adapted to retain fiber bristles.

15. The broom holder as set forth in claim 14, wherein said means to clamp said collar body on said head comprises an internal inverted U-shaped internal channel on said collar body, a first slot on the bottom face of said collar body parallel to and opening into said channel and retaining edges formed on the sides of said first slot on said channel to retain said head in said channel.

16. The broom holder as set forth in claim 15, wherein said clamping means further comprises means to lock said head in position relative to said collar.

17. The broom holder as set forth in claim 14, wherein said head comprises a second slot parallel to and opening into said circular channel and tapered edges on said circular channel and said second slot adjacent each other adapted to mate with said broom strip angled sides.

18. The broom holder as set forth in claim 17, wherein said head further comprises an open channel on the bottom face of said head opening into said second slot forming upstanding corner edges on said bottom face of said head.

19. The broom holder as set forth in claim 14, wherein said broom strips comprise a plurality of broom strips of various configurations and fiber types.

20. The broom holder as set forth in claim 14, wherein said head body further extends substantially the length of said broom strips.

21. The broom holder as set forth in claim 14, wherein said broom holder further comprises means on said collar to adjust said handle adaptor attachments to various angular positions.

22. An improved broom holder for brushing newly laid concrete surfaces, said broom holder comprising a collar, a broom head and interchangeable broom strips;

said collar comprising an integral one-piece body, said body comprising an arm perpendicular to the top surface of said collar body and extending in a vertical plane with an end face of said collar body, means on said arm capable of mounting handle adaptor attachments of differing sizes and shapes quickly and easily on said collar, an internal inverted U-shaped channel extending the length of said collar body, a first slot on the bottom face of said collar body parallel to and opening into said channel, retaining edges formed on the sides of said slot and said channel to retain said head in said channel and means to adjustably secure said collar along the length of said head to said head;

said head comprising an elongated inverted U-shaped body extending substantially the length of said broom strips, said body having an internal circular channel, a second slot parallel to and opening into said circular channel, tapered edges on said circular channel and said second slot adjacent each other forming a continuous surface, an open rectangular channel on the bottom face of said head parallel to and opening into said second slot forming upstanding corner edges on said bottom face of said head and means to adjustably clamp one of said broom strips to said head;

and said broom strips are of a type comprising an elongated body having angled external sides adapted to mate with said tapered edges of said head and an internal channel adapted to retain fiber bristles.

23. The broom holder as set forth in claim 22, wherein said broom strips comprises a plurality of broom strips of various configurations and types of fibers.

24. The broom holder as set forth in claim 22, wherein said broom holder further comprises means on said collar to adjust said handle adaptor attachments to various angular positions.

* * * * *